United States Patent [19]

Besser

[11] 3,957,171

[45] May 18, 1976

[54] CONTAINER WITH ROLLING HOOPS

[75] Inventor: Richard Dean Besser, Hudson, Ohio

[73] Assignee: Inland Steel Company, Chicago, Ill.

[22] Filed: May 9, 1975

[21] Appl. No.: 576,094

[52] U.S. Cl. ..... 220/71; 220/5 R; 220/85 R

[51] Int. Cl.[2] ..... B65D 7/42

[58] Field of Search ..... 220/71, 73, 5 R, DIG. 1, 220/85 R, 85 K

[56] References Cited

UNITED STATES PATENTS

| | | | |
|---|---|---|---|
| 1,376,216 | 4/1921 | Mittinger | 220/5 R |
| 2,173,804 | 9/1939 | Hanrahan | 220/71 |
| 2,367,834 | 1/1945 | Kuhn | 220/71 |

*Primary Examiner*—William Price
*Assistant Examiner*—Steven M. Pollard
*Attorney, Agent, or Firm*—Wolfe, Hubbard, Leydig, Voit & Osann, Ltd.

[57] ABSTRACT

A metal drum or container having rubber rolling hoops extending around the outer surface thereof is provided with an improved fastening means for securing the hoops to the drum. The rubber rolling hoops are fitted between pairs of beads in the wall of the drum so that the drum can be rolled on the hoops, with each hoop forming a pair of grooves where the hoop can be clamped to the drum. A pair of metal hoop rings are fitted into the grooves in each hoop for clamping the hoop to the container. A fastener is threaded onto one end of each ring with a hole extending through the fastener for receiving the other end of the ring, which is threaded so that a nut can be screwed onto the free end of the ring and against the fastener for drawing the ring through the fastener and tightly against the hoop and the drum so as to clamp the hoop against the drum. The hole in the fastener which receives the free end of the ring is preferably spaced farther away from the drum than the threaded hole which receives the first end of the ring, so that there is ample room to thread the nut onto the free end of the ring. The same hole in the fastener is also preferably slanted so that the entry end of the hole is closer to the drum surface than the exit end to facilitate insertion of the ring therethrough.

5 Claims, 3 Drawing Figures

CONTAINER WITH ROLLING HOOPS

DESCRIPTION OF THE INVENTION

The present invention relates generally to metal drums or containers and, more particularly, to such drums or containers which have rubber rolling hoops extending around the outer surfaces thereof to permit the drums to be rolled without damaging the drums.

It is a primary object of the present invention to provide improved means of fastening rubber rolling hoops to metal drums and the like.

It is another object of the invention to provide such an improved fastening means which facilitates application of the rubber rolling hoops to the metal drums. In this connection, more specific objects of the invention are to provide such an improved fastening means which permits the rubber rolling hoops to be quickly fastened to the drum with a minimum amount of manual labor, and requiring only very simple manual operations A further object of the invention is to provide such an improved fastening means which permits the use of a simple nut rather than turn buckles to tighten the fastening means.

Other objects and advantages of the invention will be apparent from the following detailed description and accompanying drawings, in which.

While the invention will be described in connection with a certain preferred embodiment, it will be understood that it is not intended to limit the invention to that particular embodiment. On the contrary, it is intended to cover all alternatives, modifications, and equivalents as may be included within the spirit and scope of the invention as defined by the appended claims.

Figure 1:
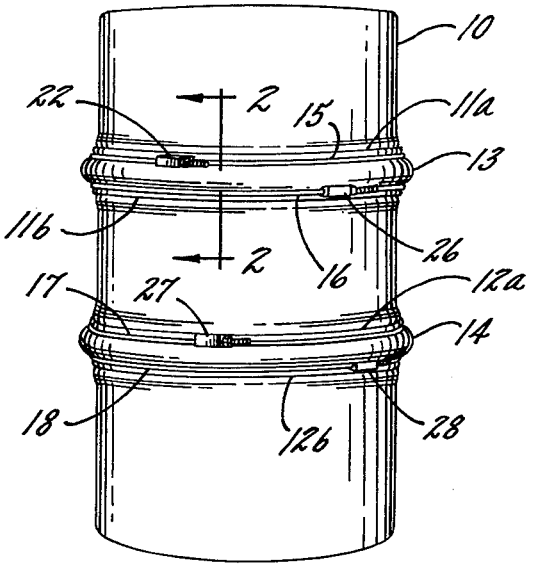
FIG. 1 is a side elevation of a metal drum fitted with rubber rolling hoops which are secured to the drum by fastening means embodying the present invention.
Figure 2:
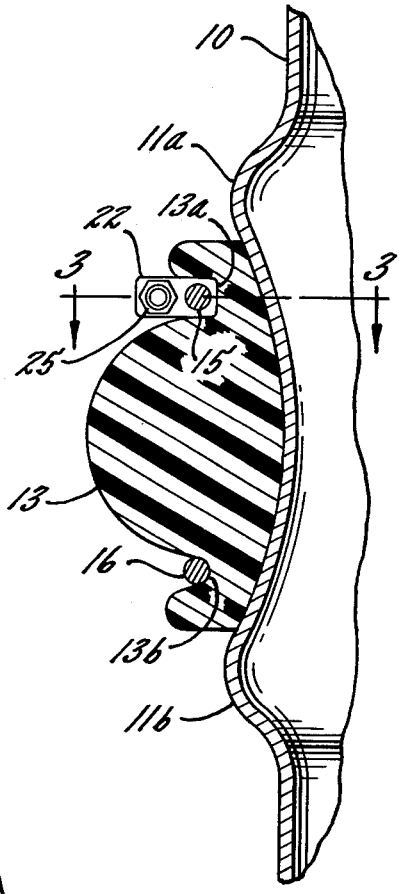
FIG. 2 is an enlarged section taken along line 2—2 in FIG. 1.
Figure 3:
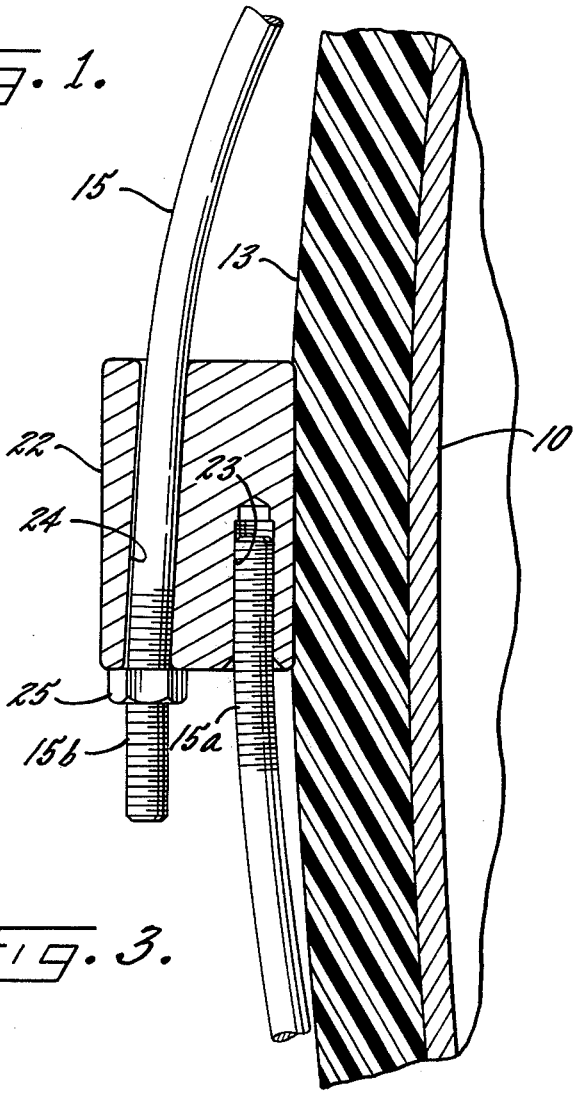
FIG. 3 is an enlarged section taken along line 3—3 in FIG. 2.

Turning now to the drawings, there is illustrated a conventional metal drum 10 having two pairs of beads 11*a*, 11*b* and 12*a*, 12*b* formed in the side walls thereof for receiving a pair of rubber rolling hoops 13 and 14. As shown most clearly in FIG. 2, the rubber rolling hoops 13 and 14 are fitted between the respective beads 11*a*, 11*b* and 12*a*, 12*b* so that when the drum is rolled, the only contact is with the rubber rolling hoops 13 and 14. That is, the central portion of each hoop 13 and 14 has a radial dimension much greater than that of the beads 11*a*, 11*b* and 12*a*, 12*b* so that the remaining portions of the drum are spaced away from the surface on which the drum is rolled. The corrugations beads 11*a*, 11*b* and 12*a*, 12*b* also serve to strengthen the drum walls in the region which bear the principal load during rolling of the drum.

To hold the rubber hoops 13 and 14 in place on the drum 10, each hoop forms a pair of grooves 13*a*, 13*b* and 14*a*, 14*b* for receiving a pair of retaining rings. Thus, the upper hoop 13 is held in place by a pair of retaining rings 15 and 16, and a similar pair of retaining rings 17 and 18 hold the lower hoop 14 in place. As can be seen most clearly in FIG. 2, the grooves 13*a* and 13*b* hold the rings 15 and 16 on the loop 13, and the beads 11*a* and 11*b* prevent the hoop from moving axially along the drum surface so that the hoop is retained in the desired position on the drum.

In accordance with one important aspect of the present invention a fastener is threaded onto one end of each retaining ring with a hole extending through the fastener for receiving the second end of the ring. The second end of the ring is threaded to receive a nut which is screwed onto the ring and against the fastener for drawing the ring through the fastener and tightly against the hoop and container so as to clamp the hoop against the container. Thus, in the illustrative embodiment a fastener 22 forms a threaded bore 23 for receiving a threaded end 15*a* of the retaining ring 15. This end 15*a* of the retaining ring is normally threaded onto the fastener 22 prior to application of the ring to the drum 10 and the hoop 13. The fastener is then positioned within the groove 13*a* and the ring 15 is wrapped around the drum with the second end 15*b* of the ring being passed through a hole 24 extending through the fastener. A nut 25 is then screwed onto the threaded free end 15*b* of the ring 15 until it engages the end wall of the fastener 22. Further advancement of the nut 25 along the ring end 15*b* then draws the ring 15 through the fastener 22, thereby drawing the ring 15 tightly against the hoop 13 and the drum 10 so as to clamp the hoop firmly against the drum.

In order to facilitate the application of the nut 25 to the free end 15*b* of the retaining ring, the hole 24 is preferably formed through the fastener 22 at a location outboard of the hole 23, i.e., the hole 24 is spaced farther away from the drum surface than the bore 23. This leaves the free end 15*b* of the retaining ring unobstructed so that the nut 25 can be easily applied to the end of the ring and screwed thereover against the fastener 22. It will be appreciated that the tightening of the nut 25 against the fastener 22 can be accomplished by means of a conventional wrench, so that there is no need to manipulate the more cumbersome and time-consuming turn buckles that have been employed in many prior fastening devices.

To facilitate insertion of the free end 15*b* of the retaining ring into the fastener 22, the hole 24 is preferably slanted so that the entry end of the hole is closer to the drum surface than the exit end of the hole. This slanting of the hole 24 minimizes the bending required in the retaining ring 18 in the transition region between the point where the ring leaves the surface of the hoop 13 and the entry end of the hole 24. As can be seen most clearly in FIG. 2, the radial dimension of the fastener 22 is kept sufficiently small that the outboard surface of the fastener is closer to the axis of the container than the most outboard surface of the hoop 13, so that the fastener does not interfere with the rolling of the drum on the resilient surface as formed by the hoops 13 and 14.

Although the invention has been described above with specific reference to the one fastener 22 associated with the retaining ring 15, it will be understood that the fasteners 26, 27 and 28 associated with the other three retaining rings 16, 17 and 18, respectively are identical in both structure and function to the fastener 22.

As can be seen from the foregoing detailed description, this invention provides an improved means of fastening rubber rolling hoops to metal drums and the like. The improved fastener provided by this invention facilitates application of the rubber rolling hoops to the metal drums because it permits the use of a simple conventional nut to effect the tensioning of the retaining rings. Consequently, the rubber rollling hoops can be quickly fastened to the drum with a minimum amount of manual labor, requiring only the simple manual operations of wrapping the retaining rings around the drum, fitting the free ends of the rings through the fasteners, and then threading conventional nuts onto the free ends of the rings.

I claim as my invention:

1. A metal container assembly comprising the combination of a. a cylindrical metal container having a plurality of pairs of beads formed in the side walls thereof, b. a rubber rolling hoop fitted between each pair of beads so that the container can be rolled on said hoops, each hoop forming a pair of circumferential grooves where the hoop can be clamped to the drum, c. a pair of metal retaining rings fitted within the grooves in each hoop for clamping the hoop to the container, d. and a fastener threaded onto one end of each retaining ring and having a hole extending therethrough for receiving the second end of the ring, said second end of the ring being threaded with a nut screwed thereon and against said fastener for drawing the ring through said fastener and tightly against the hoop and container so as to clamp the hoop to the container.

2. A metal container assembly as set forth in claim 1 wherein said fastener is a single unitary member.

3. A metal container assembly as set forth in claim 1 wherein the radially outermost surface of said fastener is closer to the axis of the container than the radially outermost surface of said hoop.

4. A metal container assembly as set forth in claim 1 wherein the entry of the hole through said fastener is closer to the container surface than the exit end of said hole.

5. A metal container assembly as set forth in claim 1 wherein said hoops are made of resilient material.

* * * * *